US006237655B1

(12) United States Patent
Gumbrecht

(10) Patent No.: US 6,237,655 B1
(45) Date of Patent: May 29, 2001

(54) APPARATUS FOR HOLDING A FLUID BAG COMPOSED OF GAS-TIGHT MATERIAL

(75) Inventor: Walter Gumbrecht, Herzogenaurach (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/383,650

(22) Filed: Aug. 26, 1999

(30) Foreign Application Priority Data

Aug. 26, 1998 (DE) ..... 198 38 787

(51) Int. Cl.[7] ..... B65B 3/00

(52) U.S. Cl. ..... 141/390; 141/114; 220/495.05

(58) Field of Search ..... 141/329, 114, 141/313, 314, 316, 391, 390; 222/105; 229/117.27, 117.28, 117.29, 117.3, 117.31, 117.32, 117.33, 117.34, 117.35; 220/495.01, 495.02, 495.03, 495.04, 495.05, 495.06, 495.07, 495.08, 495.09, 495.1, 495.11

(56) References Cited

U.S. PATENT DOCUMENTS

| | | | | |
|---|---|---|---|---|
| 2,564,163 | * | 8/1951 | Leperre | 141/2 |
| 3,042,086 | * | 7/1962 | Winchell | 141/390 |
| 3,321,070 | * | 5/1967 | Childs | 206/525 |
| 3,383,026 | * | 5/1968 | McGee | 229/117.27 |
| 3,687,051 | * | 8/1972 | Wilke | 396/630 |
| 4,346,743 | * | 8/1982 | Miller | 141/3 |
| 5,332,121 | * | 7/1994 | Schmidt et al. | 222/95 |
| 5,429,254 | * | 7/1995 | Christine | 215/11.1 |
| 5,516,007 | * | 5/1996 | Larson | 222/105 |

* cited by examiner

*Primary Examiner*—Gregory L. Huson
*Assistant Examiner*—Peter deVore
(74) *Attorney, Agent, or Firm*—Schiff Hardin & Waite

(57) ABSTRACT

An apparatus for holding a flat bag made of a gas-tight flexible material, to be filled with a fluid has an apparatus hollow space that is limited by a concavely cylindrically curved fixed side wall surface for a flat application of the flat bag, and two fixed front wall surfaces that face one another and are each convexly curved, for an inward bending of edge sides, positioned opposite one another, of the bag lying flat against the side wall surface.

15 Claims, 7 Drawing Sheets

APPARATUS FOR HOLDING A FLUID BAG COMPOSED OF GAS-TIGHT MATERIAL

BACKGROUND OF THE INVENTION

1. Field of the Invention

The present invention relates to an apparatus for holding a deformable fluid container (commonly called a "bag" in medical parlance) that is made of a gas-tight flexible material.

2. Description of the Prior Art

U.S. Pat. No. 4,734,184, discloses the use of a bag having a multiple layer of plastic containing a metal layer, and filled with gas-equilibrated electrolyte solutions, in particular electrolyte solutions that are pre-tonometered. The metal layer, for example an aluminum foil, forms a gas barrier that makes the bag particularly gas-tight. In contrast to, for example, a glass bottle, the flexibility of the bag resulting from the flexibility of the multiple layer also prevents an exchange of gases during the removal of the solution, since, in contrast to a glass bottle, the bag can collapse during the removal of the solution, and need not be vented.

SUMMARY OF THE INVENTION

An object of the present invention is to provide a bag that is made of a gas-tight flexible material and which is to be filled with fluid, wherein the gas-tightness can be ensured even if there is a risk of the occurrence of a gas leak of the bag, given a bending, buckling, crimping and/or folding of this material.

This object is achieved in any apparatus according to the invention having a hollow space that is limited by a concavely cylindrically curved fixed side wall surface that allows a flat application of the unfilled flat bag, and two fixed front wall surfaces of the bag that face one another and are each convexly curved, causing an inward bending of the edge sides, these convex surfaces being positioned opposite one another, and lying flat against the side wall surface.

The invention is based on the observation that a bag having a multiple layer of plastic that contains a metal layer tend toward a breakage of the metal layer when the multiple layer is bent, in particular when a critical angle is exceeded, or due to multiple bending during manufacture, filling, shipping, and in particular handling by the end user. The gas-tightness is no longer guaranteed in case of breaks in the metal layer.

In addition, the invention is based on the finding that this problem is due in particular to the geometries of the empty and filled bag. The bag conventionally has two multiple layers between which there is located the hollow space in the bag, to be filled with the fluid. Before the bag is filled, the hollow space thereof is evacuated in a suitable manner. When the bag has been evacuated, the two multiple layers lie flat against one another, in close contact, so that the bag has a two-dimensional flat shape. After filling the bag with fluid, its geometry has changed into a three-dimensional shape that exhibits folds that can cause breaks in the metal layer.

The inventive apparatus forms a protective apparatus for such a bag, this protective apparatus taking into account the differing geometries of the empty (in particular evacuated) bag and the filled bag. The specially shaped hollow space of this apparatus serves to hold the empty (in particular evacuated) bag before filling, and to fix the geometry of the filled bag. The shape of the hollow space is selected such that the empty bag held therein advantageously undergoes only minimal folding during the filling, and the filled bag exhibits a minimum of folds, so that buckling, crimping, folding or other excessive bending of the material of the bag, in particular the metal layer in a multiple layer of plastic, is prevented.

In further embodiments the inventive apparatus can have one or more of the following features. The front wall surfaces can be curved in mirror-symmetrical fashion to one another. An additional side wall surface, enclosing the apparatus hollow space, can be arranged opposite the side wall surface. The additional side wall surface can be curved in concavely cylindrical fashion, mirror-symmetrically to the one side wall surface. The one side wall surface and additional side wall surfaces can be constructed so as to be capable of being removed from one another. A front wall surface and a side wall surface can be pivoted relative to one another around a common axis of rotation. The axis of rotation common to a front wall surface and the side wall surface can be arranged at a vertex of curvature of a side wall surface.

In order to enable the empty bag held in the hollow space of the apparatus to be filled with fluid, if necessary an opening can be formed in at least one wall surface of this hollow space, through which opening a bag projection, that protrudes from the bag fits, this projection containing a filling opening, connected with the hollow space of the bag, for filling the bag with fluid. This opening is sealed in gas-tight fashion after filling. Such an opening is required at least when the hollow space of the apparatus holding the bag is closed on all sides during filling of the bag.

In a bag having a multiple layer made of plastic, in particular a multiple layer containing a metal layer, the problem is known to arise that a filling opening for filling the bag with fluid must be made of a material that can be fused with an inner layer of the multiple layer. If, for example, the inner layer of the multiple layer is a plastic, e.g. polypropylene, the material of the filling opening, which material is in contact with the inner layer, must also be made of the same plastic or similar as this layer.

The gas permeability of plastic materials is much greater than that of a metal foil, so that openings made of plastic reduce the storage life of gas-equilibrated solutions, and are not suitable as gas-tight seals.

The problem of the gas-tight sealing of the filling opening for filling the bag can be solved by sealing this opening by means of heat fusion after filling the bag with the fluid, so that the presence of gas-permeable material next to or lateral to the inner layer of the multiple layer is avoided.

An opening for removing the fluid from the filled bag must be sealed in gas-tight fashion preceding the opening. Preferably, a special opening for removing the fluid is entirely omitted in the inventive bag apparatus. In order to enable connection to the bag for removal of the fluid, the bag is perforated with the tip of a hollow needle, however, such a procedure tends to damage the wall of the bag.

In order to enable perforation, with the tip of a hollow needle, of the bag filled with fluid and held in the hollow space of the inventive apparatus, this apparatus has an opening in a wall surface for the introduction of the tip of a hollow needle into the hollow space from the outside.

The risk of damaging the wall of the bag is avoided, or at least reduced, in an embodiment wherein the bag held in the hollow space is fastened to the wall surface having the opening for the introduction of the tip of the hollow needle, by means of an adhesive layer located opposite this opening. In addition, for the protection of the wall of the bag it is advantageous for the opening for the introduction of the tip of the hollow needle to be sealed by a covering layer made of elastic material, which covering layer is pierced by the tip of the hollow needle. A diameter of the opening for the introduction of the tip of the hollow needle is advantageously selected to be substantially equal to a cross-sectional diameter of the hollow needle. Each of these three measures contributes to the prevention of a perforation of any other part of the bag during the perforation of the covering layer and the wall of the bag with the tip of a hollow needle.

According to the above, in the inventive apparatus a bag, in a pre-fastened state, is filled with fluid, and the fluid is stored with a maximum integrity against leakage with the gas-tightness of the bag maintained, and the fluid can be removed by perforation of the bag material, while protecting the bag. The inventive apparatus provides an inexpensive manufacturing process and reliable and simple handling by the end user.

In particular, the inventive apparatus is suitable for holding a bag that contains a fluid for the calibration of a chemical sensor. For example, a chemical sensor or a sensor system, in particular an analysis system in a hospital used for the determination of blood gases such as pO2, pCO2, of pH, and of electrolytes, has to be calibrated during operation. For this purpose, each such sensor must be rinsed (flushed) with a fluid in the form of a liquid and/or gas mixture having a known composition (see e.g. European Application 0 790 499).

The inventive apparatus can be constructed as a simple housing made of plastic that can, for example, be manufactured by injection molding.

In an embodiment of the inventive apparatus at least two apparatus hollow spaces are provided, these being limited by respective concavely cylindrically curved fixed side wall surfaces for a flat application of a flat bag in each space, and two fixed front wall surfaces that face one another and are each convexly curved, for an inward bending of edge sides of the bag, positioned opposite one another, lying flat against the respective side wall surfaces.

In a further embodiment of the inventive apparatus, a hollow space is provided for holding a waste disposal bag. This hollow space can be realized in the apparatus in a particularly simple manner, and in certain circumstances can arise naturally to the geometry of the apparatus.

The figures are not to scale.

DESCRIPTION OF THE PREFERRED EMBODIMENTS

Figure 1:
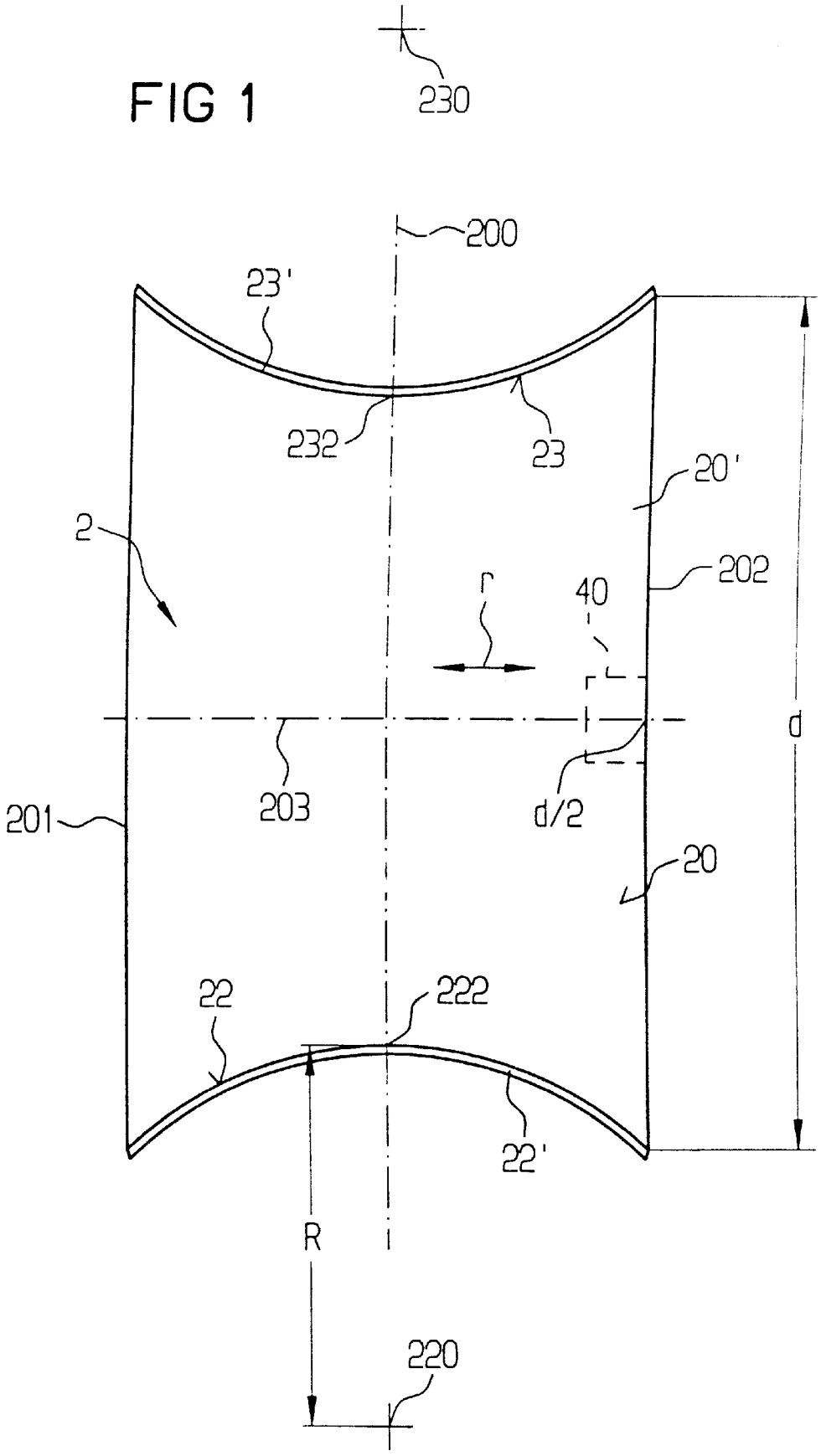
FIG. 1 shows an apparatus hollow space of the inventive apparatus in a top view of the concave side wall surface that limits this hollow space.
Figure 2:
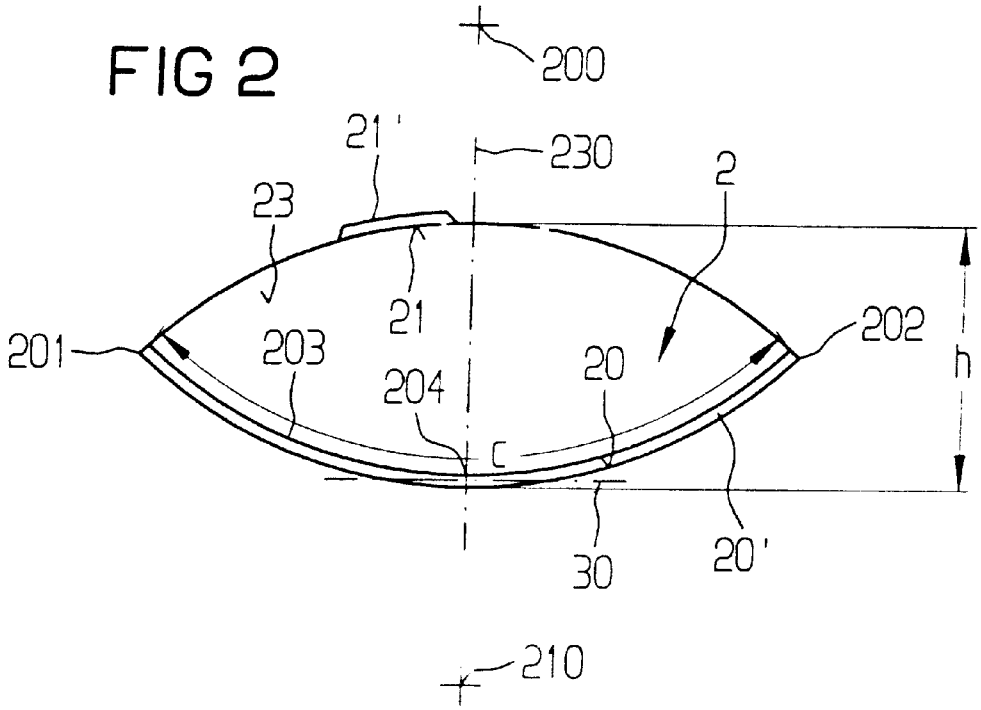
FIG. 2 shows a vertical cross-section through the apparatus according to FIG. 1, along the line 203 in FIG. 1.
Figure 3:
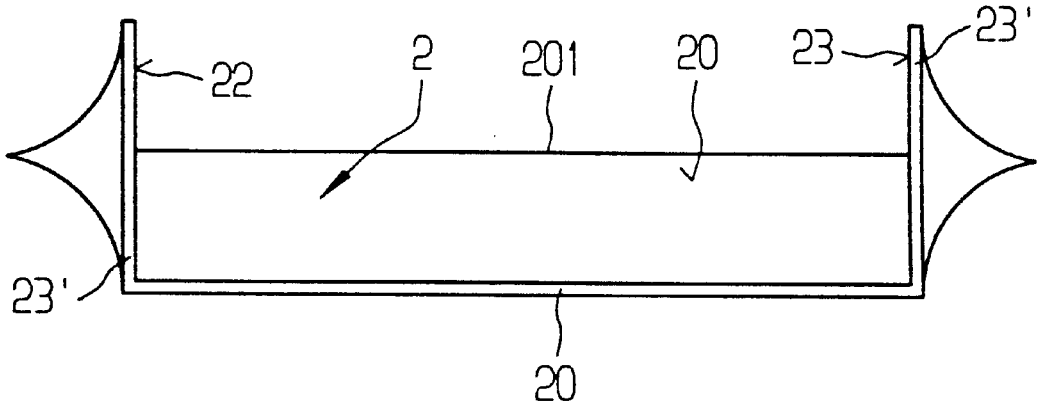
FIG. 3 shows a vertical longitudinal section through the apparatus according to FIG. 1, along the axis 200 in FIG. 1.
Figure 4:
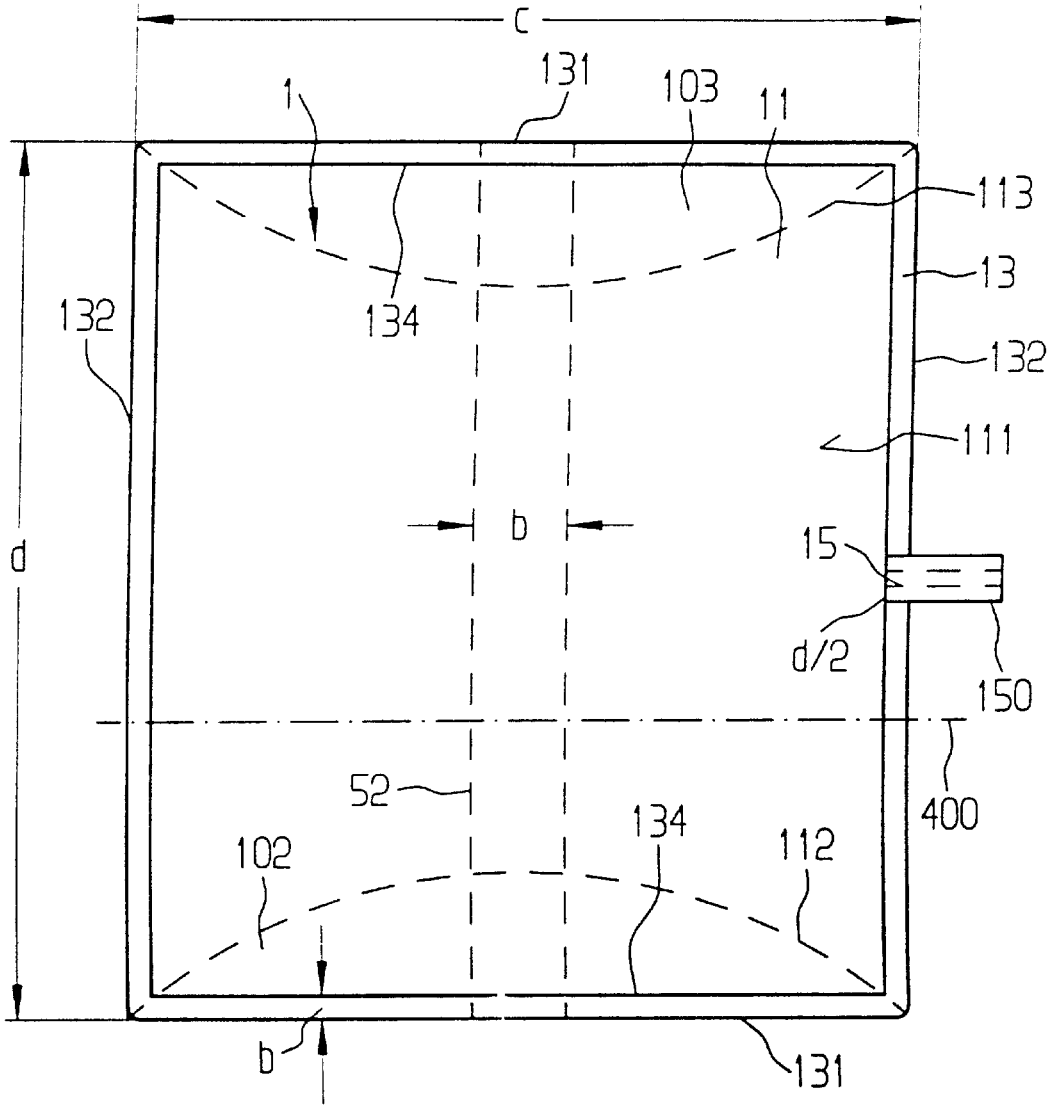
FIG. 4 shows a top view of a flat bag to be held in the apparatus according to the FIGS. 1 to 3.
Figure 5:
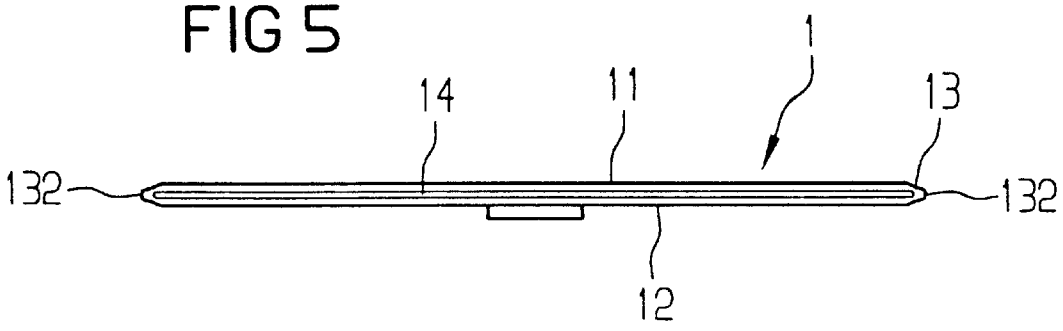
FIG. 5 shows a vertical cross-section through the bag according to FIG. 4, along the line 400 in FIG. 4.

The exemplary apparatus shown in FIGS. 1 to 3 is used to hold a bag 1 that is to be filled with a fluid, this bag 1 being shown in FIGS. 4 and 5. The apparatus has an apparatus hollow space 2, geometrically adapted to this bag 1, for receiving the bag 1.

The apparatus hollow space 2 is limited by a fixed (rigid) side wall surface 20 and two fixed front wall surfaces 22, 23 that face one another.

The side wall surface 20 extends parallel to a straight longitudinal axis 200, and is limited on both sides of the longitudinal axis 200 by two lateral boundary lines 201, 202 that are parallel to the longitudinal axis 200. The wall surface 20 is for example concavely, cylindrically curved in mirror-symmetrical fashion in relation to a first plane that contains the longitudinal axis 200, this plane being disposed vertically to the plane of the drawing in FIG. 1 and in FIG. 2, and in FIG. 3 is the plane of the drawing itself.

The first plane perpendicularly intersects a second plane that contains the two lateral boundary lines 201, 202; in FIG. 1 this second plane is the plane of the drawing, in FIG. 2 it is disposed vertically to the plane of the drawing and extends horizontally, and in FIG. 3 it is disposed vertically to the plane of the drawing and extends parallel to the longitudinal axis 200.

The longitudinal wall surface 20 lies surface-wide against the flat empty bag 1. A line of curvature 203, which proceeds in the direction R perpendicular to the longitudinal axis 200, has on the side wall surface 20 between the lateral boundary lines 201, 202, a curve length that is substantially equal to the length c of an edge side 131 of the substantially rectangular edge 13 of the bag 1.

Each front wall surface 22 and 23 extends parallel to a straight axis 220, or 230, that lies in the first plane and that intersects the second plane perpendicularly. The front wall surfaces 22 and 23 are respectively curved in the direction R perpendicular to the respective axes 220 and respectively 230, for example, convexly, cylindrically curved mirror-symmetrically in relation to the first plane. The front wall surfaces 22 and 23 extend to the lateral boundary lines 201, 202 of the side wall surface 20, and have the same curvature shape as the one side wall surface 20.

In FIG. 1, each of the axes 220 and 230 is perpendicular to the plane of the drawing, and in FIG. 2 proceeds vertically, and in FIG. 3 horizontally, in the plane of the drawing.

On each lateral boundary line 201, 202, there is a distance d between the two front wall surfaces 22, 23 that is substantially equal to the length d of the other edge side 132—perpendicular to the one edge side 131—of the rectangular edge 13 of the bag 1.

The front wall surfaces 22 and 23 preferably are convexly curved in mirror-symmetrical fashion to one another, i.e., they are convexly curved in mirror-symmetrical fashion in relation to a plane that is perpendicular to the longitudinal axis 200 and that is disposed in the center between these wall surfaces 22 and 23, i.e., at d/2 in FIG. 1. For example, this plane contains the curvature line 203 on the side wall surface 20.

The wall surfaces 20, 22 and 23 can be formed by relatively thin fixed shells 20', 22' and 23', made for example of a plastic, which are curved corresponding to the wall surfaces 20, 22, and 23, and can be connected with one another fixedly and without gaps. In this case, the inventive apparatus can easily be mass-produced at low cost, using an injection molding process.

For a variety of reasons, it can be useful to construct the apparatus such that a front wall surface 22 and/or 23 can be pivoted relative to the side wall surface 20, around an axis of rotation 30 (See FIG. 2), e.g. around an axis of rotation 30 that is perpendicular to the first plane, the axis 30 preferably being arranged at a vertex 204 of the curvature of the side wall surface 20. In such a construction, it is also possible to mass-produce the apparatus at low cost using an injection molding process, because the axis of rotation 30 can be realized as a flexible connection made of plastic between the shell 20' and 22' and/or 23', which operates in the manner of a hinge and can be simultaneously cast.

The apparatus also can be constructed so that, as shown in FIG. 2, an additional side wall surface 21 that encloses the apparatus hollow space 2 is arranged opposite the side wall surface 20, this additional surface 21 extending parallel to the straight longitudinal axis 200 of the one side wall surface 20.

The additional wall surface 21 can also be formed by a relatively thin fixed shell 21', shown in fragmented form in FIG. 2, that is made of plastic and that is curved corresponding to this wall surface 21. The shell 21' can be connected with one or more of the other shells 20', 22' and 23', e.g. fixedly ard without gaps, or by means of an axis of rotation 30, so that it is ensured that the bag 1 can be brought into the apparatus hollow space and held therein in the provided manner. In this case as well, the inventive apparatus can easily be mass-produced at low cost using an injection molding method.

Preferably, the shell 20' of the one side wall surface 20 and the shell 21' of the additional side wall surface 21 are fashioned so as to be able to be removable from one another.

The additional side wall surface 21 can, for example, like the one side wall surface 20, be curved in concave cylindrical fashion in the direction R perpendicular to the longitudinal axis 200 of the one wall surface 20 inside the two lateral boundary lines 201, 202 of the one wall surface 20, mirror-symmetrically to this one wall surface 20. In other words, the wall surfaces 20 and 21 are concavely cylindrically curved in mirror-symmetrical fashion relative to the first plane. In addition, the additional wall surface 21 preferably has the same curvature shape as the wall surface 20.

Preferably, the side wall surface 20 and the additional side wall surface 21 are fashioned so as to be able to be removable from one another.

The bag 1 shown in FIGS. 4 and 5, already referred to above, and the apparatus hollow space 2 of the apparatus according to FIGS. 1 to 3 for holding this bag 1, are matched to one another in their geometrical shape such that the empty bag 1 is held in the apparatus hollow space 2 and can be filled with fluid, without the occurrence of any buckling, crimping, folding or other excessive bending of the material of the bag 1, which can lead to a gas leakage from the bag 1.

The depicted bag 1 has two flexible sheets 11, 12 made of a gas-tight material, of which only the sheet 11 can be seen in FIG. 4, since the sheet 12 is located under the sheet 11 and is covered.

The sheets 11 and 12 are connected with one another in gas-tight fashion so as to form a gas-tight bag wall along a common flexible edge 13, and provide between them a hollow space 14 that is to be filled with the fluid.

For example, the sheets 11 and 12 are respectively made of a multiple layer of one or more plastics that contain at least one metal layer as a gas barrier, the two multiple layers being welded, or connected in some other way, with one another in gas-tight fashion along the edge 13.

In an empty state of the bag 1, the edge 13 is substantially rectangular in shape, and the sheets 11 and 12 lie on one another in flat, loose fashion within the edge 13. A filling opening 15 for filling the hollow space 14 from the exterior with the fluid, is connected with the hollow space 14 and is sealed in gas-tight fashion after the filling, and is contained in a bag projection 150 that protrudes from the bag 1.

The filling opening 15 can be sealed by heat fusing.

The bag projection 150 is, for example, fashioned on the edge 13, e.g. in the center d/2 of one of the two other edge sides 132, which are arranged parallel to the lateral boundary lines 201, 202 of the side wall surface 20.

In FIG. 1, an opening 40 of the surface 20 is indicated, in broken lines, on the lateral boundary line 202 of the side wall surface 20 at a point d/2 that bisects the length d, into which opening the bag projection 150 fits, and through which this projection 150 can protrude outwardly from the apparatus hollow space 2 when the bag 1 is fastened in this space 2. Such an opening 40 is required at least when the bag 1 is to be filled with fluid when the apparatus hollow space 2 is sealed on all sides.

Before filling with fluid, the bag 1 can be evacuated through the filling opening 15. In the evacuated state, the sheets 11 and 12 are in close surface contact with one another.

Approximate sample dimensions of a bag 1 are c=14.5 cm and d=19 cm.

For filling with fluid, the evacuated, flat rectangular bag 1 is brought into the apparatus hollow space 2 in such a way that the bag 1 lies with as much of its surface as possible against the curved side wall surface 20, so that it is curved in the same way as this surface 20, and only end sections 102 and 103 of the bag 1 are folded over at an angle to the longitudinal axis 200 at the vertices 222 and 232 of curvature—intersected by the longitudinal axis 200—of the respective front wall surfaces 22 and 23.

In FIG. 4, the end section 102 of the bag 1, which is to be folded over, is the region surrounded by the curved broken line 112 and by the edge side 131 of the edge 13 of the bag 1. The end section 103 to be folded over is the region surrounded by the curved broken line 113 and the other edge side 131. The angle by which the end sections 102 and 103 are respectively to be folded over should be as close to 90° as possible, so that these end sections 102 and 103 lie on the respective front wall surfaces 22 and 23 as tightly as possible and over as much of the surface as possible, and are curved in the same way as these wall surfaces 22 and 23.

For this purpose, the flat bag 1 is fastened to the side wall surface 20 in such a way that the two other edge sides 132, positioned opposite one another, of the edge 13, which are for example side walls of the bag 1, proceed parallel to the two boundary lines 201 and 202, and the bag 1 does not extend laterally past the boundary lines 201 and 202.

The folding over of the end sections 102 and 103 of the bag 1 at the vertices 222 and 232 of curvature of the respective front wall surfaces 22 and 23 results naturally when the front wall surfaces 22 and 23 are fixed relative to the side wall surface 20. Otherwise, the folding over can, for example, be accomplished by means of the rotation of the front wall surface 22 and/or 23 around the axis of rotation 30.

Figure 6:
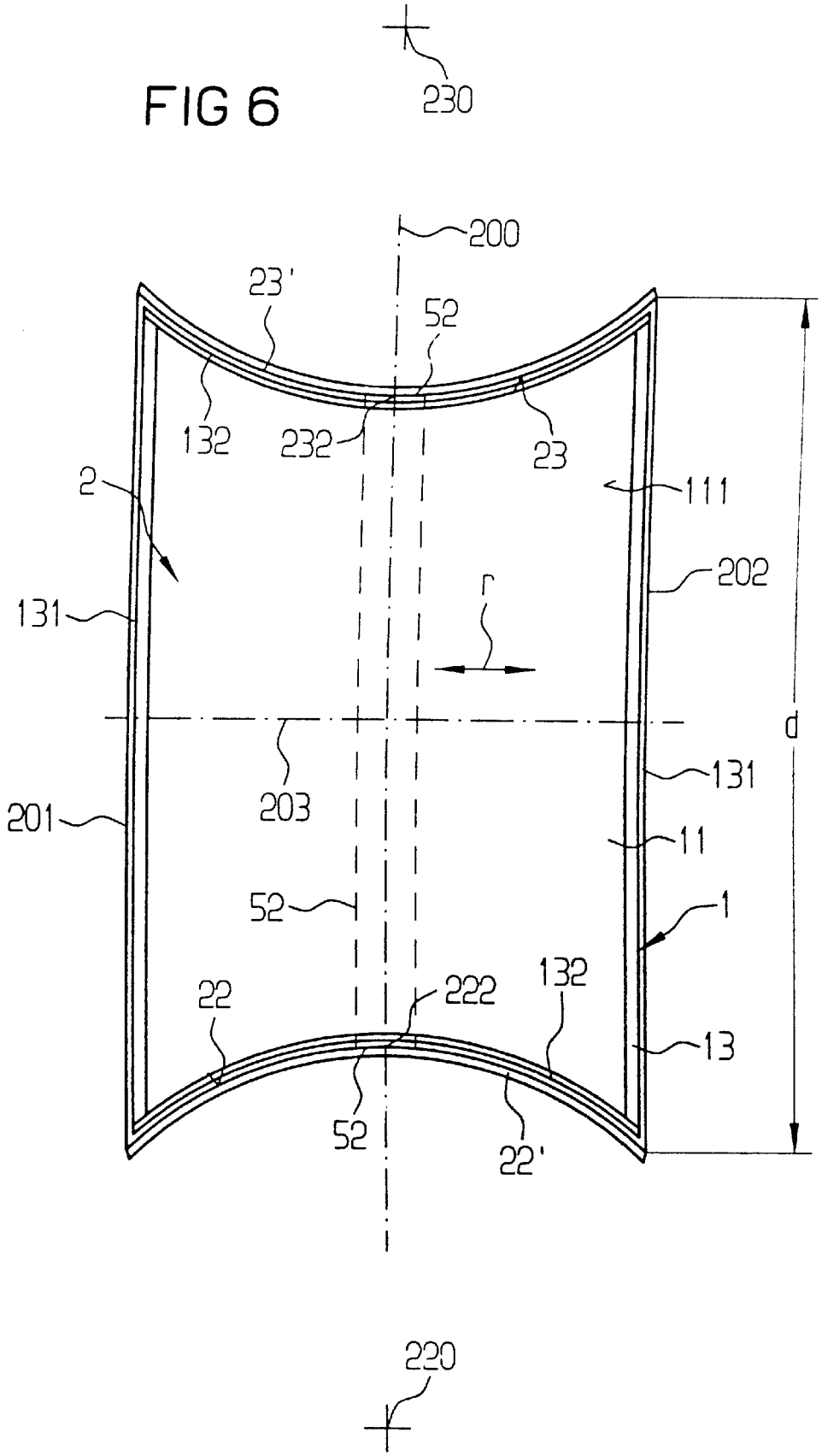
FIG. 6 shows the apparatus hollow space of the inventive apparatus in the same top view as in FIG. 1, but with a bag fastened on the side wall surface, with edge sides of the bag being bent inwardly by the front wall surfaces.

When the end sections 102 and 103 are folded over, each of the two edge sides 131 of the rectangular edge 13 of the bag 1—which edge sides are located opposite one another and are perpendicular to the other edge sides 132—is bent inwardly through the respective vertices of curvature 222 and 232 of the front wall surfaces 22 and 23, i.e. in the direction toward the opposite edge side 131, as shown in FIG. 6.

As shown in FIG. 6, the edge sides 131—which lie closely on the respective front wall surfaces 22 and 23, at least at the vertices 222 and 232 of curvature of these surfaces 22, 23—each have a curvature similar to the front wall surfaces 22, 23. If, for example, and as shown in the figures, all three wall surfaces 20, 22 and 23 are respectively curved in circular cylindrical fashion, the edge sides 131 respectively proceed in a fashion similar to a circular arc.

Preferably, all three wall surfaces 20, 22 and 23, and, if necessary, also the additional wall surface 21, are curved in a circularly cylindrical fashion, and have the same cylinder radius R. The size of this radius R is determined by a radius of a curvature of the sheets 11 and 12 and an inward bending of the edge sides 131, located opposite one another, of the edge 13, which always arise naturally during the filling of the bag 1 with fluid, and are present when the bag 1 is filled to tautness, regardless of whether the bag 1 is held in the apparatus or not. The apparatus effects a transition that is particularly protective of the material of the bag from the two-dimensional flat shape to the three-dimensional shape of the bag 1 during the filling process, if R is selected approximately equal to such a radius of curvature predetermined by the bag 1. In the rectangular bag 1 serving as an example, an approximate value for R is roughly equal to c.

The bag 1 is fastened to the side wall surface 20, preferably using an adhesive layer. In the bag 1 according to FIG. 4, such an adhesive layer is made for example of an adhesive strip 52 that is adhesive on both sides, which adheres externally to the lower sheet 12 and extends in the center of the bag 1 parallel to the two other edge sides 132, from one edge side 131 up to the opposite edge side 131.

In the above-indicated sample dimensions of the bag 1, a width b1 of the adhesive strip 52 of approximately 2 cm is suitable.

For the fastening in the apparatus hollow space 2, the bag 1 is attached on the side wall surface 20 in such a way that the lower sheet 12 faces this surface 20, and the strip 52 extends along the longitudinal axis 200 on the vertex 204 of curvature of this surface 20. Subsequently, the evacuated flat bag 1 adheres along the entire length of the side wall surface 20, between the vertices of curvature 222 and 232 of the two front wall surfaces 22 and 23, and lies closely on this surface. By this means, the outer surface 111 of the sheet 11 of the bag 1—which surface 11 can be seen in each of FIGS. 4 and 6—is curved in a concavely cylindrical fashion between the front wall surfaces 22 and 23, and has generally the same curvature shape as the side wall surface 20.

The adhesive strip 52 also causes the folded-over end sections 102 and 103 of the bag 1 to adhere at the vertices 222 and 232 of the front wall surfaces 22 and 23.

The bag 1 fastened in the apparatus hollow space 2 in this way is filled with a fluid through the filling opening 15. The filling process is shown on the basis of FIGS. 7 and 8, which respectively show a longitudinal section—corresponding to the section according to FIG. 3, but simplified—through the exemplary apparatus.

Figure 7:
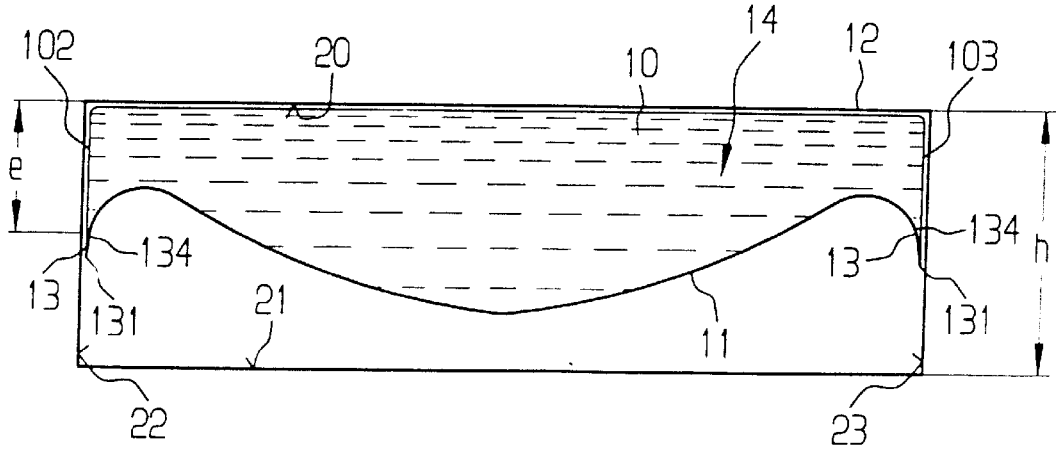
FIG. 7 shows a longitudinal section, corresponding to the section according to FIG. 3 but shown in a simplified manner, through an inventive apparatus having a bag, held in the hollow space of the apparatus, during a filling process, the bag being partially filled.
Figure 8:
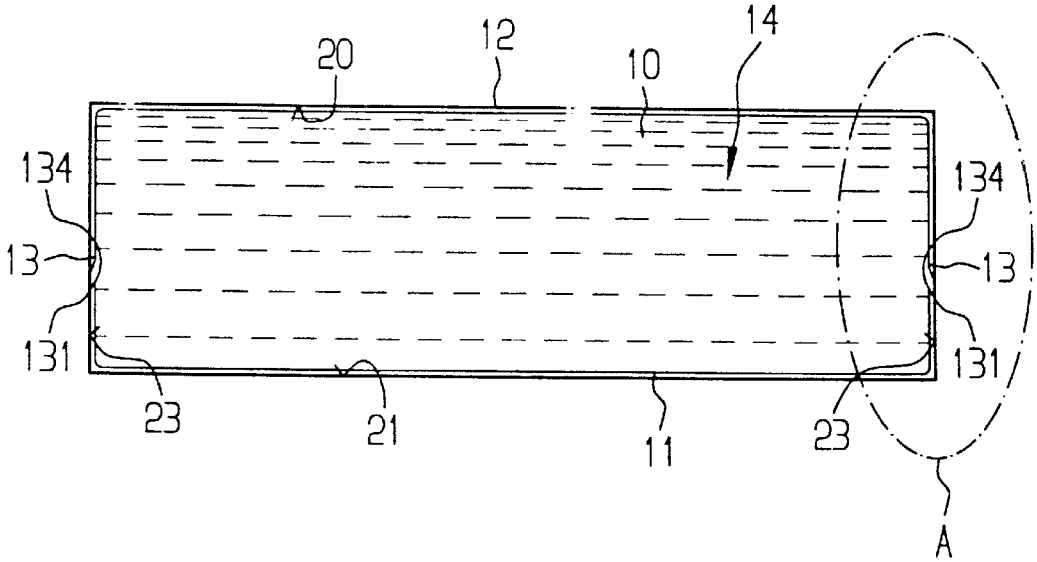
FIG. 8 shows the section according to FIG. 7, wherein the bag is completely filled.

In both FIGS. 7 and 8, the apparatus hollow space 2 is limited by a side wall surface 20, an additional side wall surface 21, and two front wall surfaces 22 and 23, and is sealed on all sides. The bag 1 is fastened with the sheet 12 to the side wall surface 21 and to the front wall surfaces 22 and 23.

During filling of the bag 1, the apparatus is arranged as shown in FIGS. 7 and 8, i.e., the side wall surface 20 to which the bag 1 is fastened is arranged horizontally and is oriented downwardly, so that the bag 1 expands downwardly during the filling. This has the advantage that during filling of the bag 1, the weight of the fluid in the bag 1 assists in the unfolding of the bag 1.

In FIG. 7, the hollow space 14 of the bag 1 is partially filled with a fluid 10. The sheet 11, now arranged at the bottom, has curved convexly downwardly between the front wall surfaces 22 and 23, and remains curved concavely upwardly in the vicinity of each front wall surface 22 and 23, determined by the section of the edge 13 lying flat at the vertex of curvature 222 or 223 of the vertical front wall surfaces 22 and 23. This section forms an edge strip of a determined width b, limited by the edge side 131 and by a boundary line 134, parallel thereto, at the hollow space 14 of the bag 1.

For the exemplary dimensions of the bag 1 indicated above, the width b of the edge strip is, for example, approximately 6 mm.

In FIG. 8, the hollow space 14 of the bag 1 is entirely filled with the fluid 10, and has unfolded completely, so that it lies against substantially the entire surfaces of all wall surfaces 20, 21, 22 and 23.

In the unfolding of the bag 1 during the filling process, the section of the edge 13 limited by the boundary line 134 remains in flat contact against the respective front wall surfaces 22 and 23, and the sheet 11 rotates about the boundary line 134 of this section, as around a joint. It is advantageous for the boundary line 134 in the representation according to FIGS. 7 and 8 to be curved only horizontally, and not also vertically. In addition, it is advantageous for the curvature shapes of the side wall surface 20 and of the front wall surfaces 22 and 23 to be identical, preferably circular.

The boundary line 134 of each folded-over end section 102 and 103 of the bag 1, acting as a joint, should be arranged for an optimal unfolding of the bag 1 without producing any bending, buckling, crimping and/or folding during the filling process, at a vertical distance e from the vertex of curvature 204 of the one side wall surface 20, which is of equal size for both folded-over end sections 102 and 103. In the example shown, it is advantageous for this distance e to be equal to h/2, or half the distance h between the vertex 204 of curvature of the one side wall surface 20 and the vertex 214 of curvature of the additional side wall surface 21.

After the termination of the filling process, the filling opening 165 of the bag 1 is heat-fused.

The removal of the fluid 10 from the bag 1 contained in the apparatus hollow space 2 with the tip of a hollow needle is explained in more detail below on the basis of FIGS. 9 and 10, which respectively show an enlarged view of the part of FIG. 8 located in the circle A.

Figure 9:
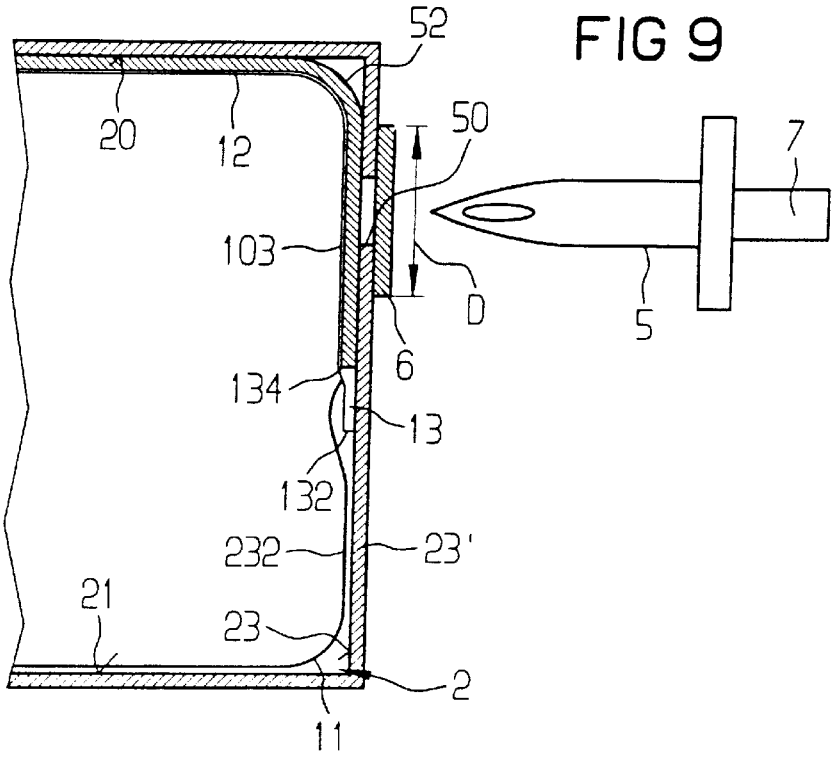
FIG. 9 shows an enlarged view of the end region, surrounded by the circle A, of the apparatus, wherein an opening is fashioned in the front wall surface for the introduction of the tip of a hollow needle, the bag being fastened to this wall surface by means of an adhesive layer positioned opposite this opening, the opening being sealed by a covering layer made of elastic material that is pierceable by the tip of the hollow needle, the tip being guided straight to the covering layer.
Figure 10:
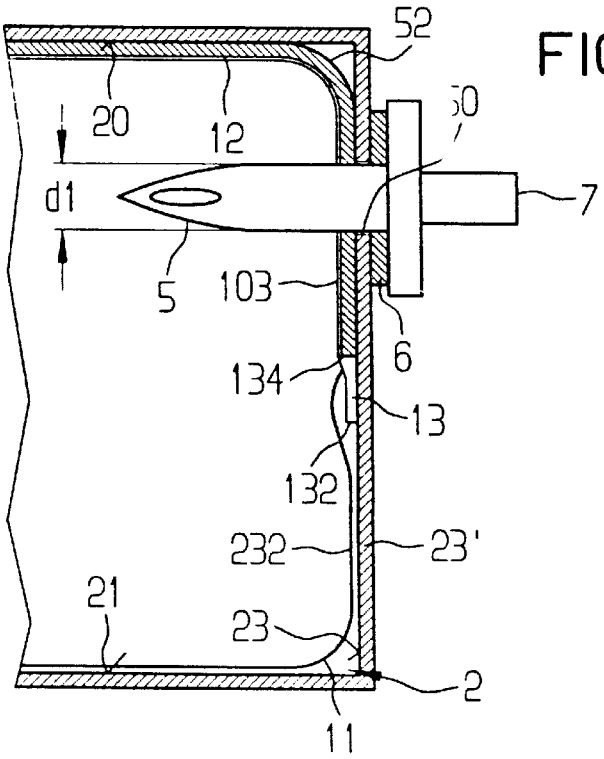
FIG. 10 shows the end region according to FIG. 9, wherein the tip of the hollow needle has pierced the covering layer and the wall of the bag.

As shown in FIGS. 9 and 10, a continuous opening 50 is fashioned in the shell 23' forming the front wall surface 23, this opening 50 being arranged in the vertex of curvature 232 of this wall surface 23, opposite the adhesive strip 52 that fastens the folded-over end section 103 to the wall surface 23.

The opening 50 serves for the introduction of the tip 5 of a hollow needle, which can for example be a steel needle, a standard plastic mini-tip, the tip of an infusion needle, etc., into the apparatus hollow space 2.

Since the folded-over end section 103 of the filled bag 1 is fastened to the wall surface 23, it can be pierced in perpendicular fashion by the tip 5 of the hollow needle, without risk of damage.

The exposed part in the opening 50 of the folded-over end section 103 covered with the adhesive agent 52 is advantageously protected against accidental damage by sealing the opening 50 with a covering layer 6 made of elastic material, e.g. silicon rubber, pierceable by the tip 5 of the hollow needle. In FIGS. 9 and 10, the covering layer 6 is arranged outside the apparatus hollow space 2. A covering layer 6 can also be arranged in the hollow space 2 between the folded-over end section 103 and the front wall surface 23.

For example, the opening 50 is circular, and has a diameter d1 of 5 mm, and the covering layer 6 forms a circular disk with a diameter D of approximately 2 cm.

FIG. 9 shows the tip 5 of the hollow needle shortly before piercing the covering layer 6 and the folded-over end section 103; FIG. 10 shows the state after piercing.

A tube 7 is connected to the tip 5 of the hollow needle, through which fluid 10 can flow out, or in.

The opening 50 for the introduction of the tip 5 of a hollow needle also can be located at a different point and on a different wall surface. For example, a continuous opening 50 can be formed in the shell 22' that forms the front wall surface 22, the shell 22' being arranged in the vertex of curvature 222 of this wall surface 22 opposite the adhesive strip 52 that fastens the folded-over end section 102 to the wall surface 22.

The apparatus also can have several openings 50, each for the introduction of the tip 5 of a hollow needle.

Figure 11:
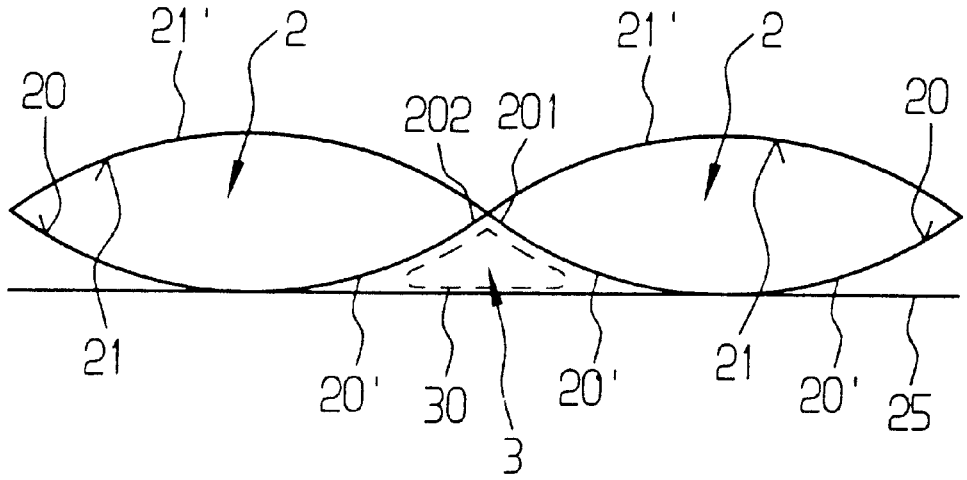
FIG. 11 shows a reduced and simplified cross-section, corresponding to FIG. 3, through an apparatus having two apparatus hollow spaces and one hollow space for receiving a waste disposal bag.

The exemplary apparatus shown in FIG. 11 has two apparatus hollow spaces 2, each being limited by a concavely cylindrically curved fixed side wall surface for a flat application of a flat bag 1, and two respective fixed front wall surfaces that face one another and are each convexly curved, for inwardly bending edge sides, positioned opposite one another, of the bag 1 lying flat against the respective side wall surface.

This exemplary apparatus can be produced by positioning lateral boundary lines of two shells 20' of identical apparatuses according to FIGS. 1 to 3 against one another, and fixedly connecting these two shells 20' with one another. For example, the boundary line 201 of the shell 20' of an apparatus can be applied to the boundary line 202 of the shell 20' of the other apparatus. Similarly, if necessary shells 21' of these two apparatus can be applied to one another and connected with one another.

In FIG. 11, a connection of the shells 20' is produced by a plate 25 made, for example, of plastic, to which the shells 20' are fastened on the side facing away from the concave side wall surfaces 20 of these shells 20'.

This type of fastening has the advantage that a hollow space 3 for the reception of a waste removal bag 300 is naturally created between the shells 20' and the plate 25. Similarly, the shells 21' can also be fastened to one another, and can create a hollow space for the reception of a waste removal bag.

Figure 12:
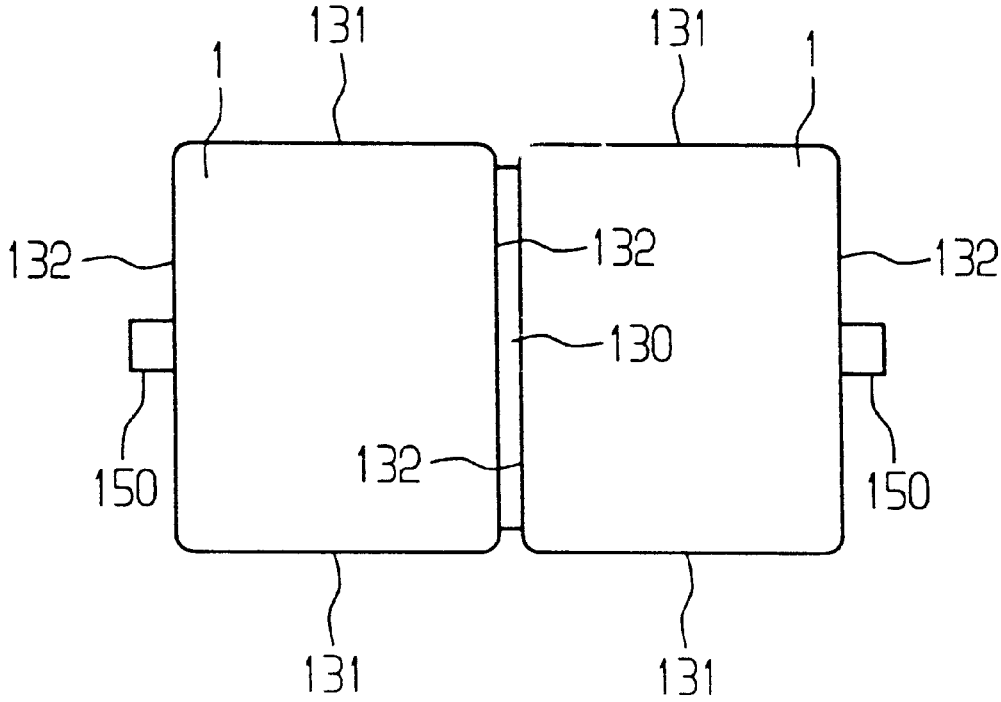
FIG. 12 shows a reduced and simplified top view, corresponding to FIG. 4, of a flat pair of bags to be held in the apparatus according to FIG. 11.

FIG. 12 shows a double bag that is to be held in the apparatus hollow spaces 2 of the apparatus according to FIG. 11, this double bag consists of two identical bags 1 according to FIGS. 4 and 5 that are connected with one another along other edge sides 132, which face one another, by means of a strip 130 of elastic material, for example plastic. These bags 1 are respectively held in the two apparatus hollow spaces 2, and the strip 130 proceeds along the two lateral boundary lines, lying one against the other, of the two shells 20', and runs parallel to these lines.

The bag projections 150 for filling the bag 1 with fluid are arranged on other edge sides 132, facing away from one another, of the two bags 1.

Although modifications and changes may be suggested by those skilled in the art, it is the intention of the inventor to embody within the patent warranted hereon all changes and modifications as reasonably and properly come within the scope of his contribution to the art.

I claim as my invention:

1. A fluid bag and holding apparatus combination comprising:

a fluid bag composed of gas-tight flexible material and fillable with a fluid, said bag being flat before being filled with a fluid;

a plurality of apparatus surfaces forming a hollow space in which said bag, in an unfilled state, is received, said bag in said unfilled state having edge sides disposed opposite each other; and said apparatus surfaces including a concavely cylindrically curved rigid side wall surface against which said bag in said unfilled state lies flat, and two rigid front wall surfaces spaced from and facing each other and being convexly curved, and against which said edge sides of said bag are adjacent when said bag lies flat against said side wall surface, said front wall surfaces respectively curving said edge sides of said bag to conform to said front wall surfaces.

2. An apparatus as claimed in claim 1 wherein said front wall surfaces are respectively curved mirror-symmetrically relative to each other.

3. An apparatus as claimed in claim 1 further comprising an additional side wall surface, disposed opposite said concavely cylindrically curved rigid side wall surface, limiting said hollow space.

4. An apparatus as claimed in claim 3 wherein said additional side wall surface is concavely cylindrically curved so as to be mirror-symmetric to said concavely cylindrically curved rigid side wall surface.

5. An apparatus as claimed in claim 3 wherein said concavely cylindrically curved rigid side wall surface and said additional side wall surface are removable from each other.

6. An apparatus as claimed in claim 1 wherein at least one of said front wall surfaces is pivotable relative to said side wall surface around a common axis of rotation.

7. An apparatus as claimed in claim 6 wherein said side wall surface has a vertex of curvature, and wherein said axis of rotation is disposed at said vertex of curvature.

8. An apparatus as claimed in claim 1 wherein said bag has a bag projection, said bag projection containing a filling opening for filling said bag with fluid, said filling opening being sealed gas-tight after filling said bag, and wherein at least one of said apparatus surfaces has an opening therein into which said projection protrudes.

9. An apparatus as claimed in claim 8 wherein said filling opening is sealable by heat fusion.

10. An apparatus as claimed in claim 1 wherein at least one of said apparatus surfaces has an opening therein adapted for introduction of a tip of a hollow needle into said hollow space from an exterior of said hollow space.

11. An apparatus as claimed in claim 10 further comprising a fastening element attaching said bag in said hollow space to said at least one of said apparatus surfaces having said opening therein.

12. An apparatus as claimed in claim 11 wherein said fastening element comprises an adhesive layer disposed opposite said opening.

13. An apparatus as claimed in claim 10 further comprising a covering layer, covering said opening, said covering layer being composed of elastic material which is pierceable by a tip of a hollow needle.

14. An apparatus as claimed in claim 1 wherein said hollow space is a first hollow space, and wherein said side wall surface is a first side wall surface and wherein said front wall surfaces are first front wall surfaces, said first side wall surface and said first front wall surfaces limiting said first hollow space, and said plurality of apparatus surfaces further comprising a cylindrically curved rigid second side wall surface and two convexly curved front wall surfaces, and wherein said bag is disposed in said first hollow space and wherein said apparatus further comprises a second bag disposed in said second hollow space, said second bag having second bag edge sides disposed opposite each other, and said second bag, in said unfilled state, lying flat against said second side wall surface and said second edge sides being curved against said second side wall surfaces, respectively.

15. An apparatus as claimed in claim 1 wherein said apparatus walls enclose a further hollow space adapted to receive a waste removal bag.

* * * * *